US006793520B1

(12) United States Patent
Wu

(10) Patent No.: US 6,793,520 B1
(45) Date of Patent: Sep. 21, 2004

(54) CABLE END CONNECTOR ASSEMBLY WITH STRAIN RELIEF

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/393,824

(22) Filed: Mar. 20, 2003

(51) Int. Cl.[7] ..... H01R 13/58
(52) U.S. Cl. ..... 439/459; 439/474
(58) Field of Search ..... 439/459, 460, 439/470, 474

(56) References Cited

U.S. PATENT DOCUMENTS 5,971,818 A * 10/1999 Juntwait et al. ..... 439/866
6,045,389 A * 4/2000 Ferrill et al. ..... 439/398
6,068,506 A 5/2000 Shen ..... 439/447
6,203,376 B1 * 3/2001 Magajne et al. ..... 439/610
6,257,914 B1 * 7/2001 Comerci et al. ..... 439/357
6,257,920 B1 * 7/2001 Finona et al. ..... 439/455
6,321,103 B1 * 11/2001 Dowd et al. ..... 600/376
6,428,344 B1 * 8/2002 Reed ..... 439/455

* cited by examiner

*Primary Examiner*—Tulsidas C. Patel
(74) *Attorney, Agent, or Firm*—Wei Te Chung

(57) ABSTRACT

An electrical connector assembly (1) includes an electrical connector (10), a cable (20), a cable clamp (30) and a cover (40) over-molded with the connector and the cable. The cable clamp includes a first crimper (31) and a second crimper (32) mated with each other. The first crimper has a frame-shaped first clamping portion, a number of latching arms (3120) and a retention finger (3100) extending from the first clamping portion into the cable (20). The second crimper has a plate-shaped second clamping portion (320) and defines a number of latching apertures (3220) and a through hole (3200) in the second clamping portion respectively receiving the latching arms and the retention finger.

17 Claims, 5 Drawing Sheets

CABLE END CONNECTOR ASSEMBLY WITH STRAIN RELIEF

BACKGROUND OF THE INVENTION

1. Field of the Invention

The present invention relates to a cable end connector assembly, and more particularly to a cable end connector assembly with a strain relief.

2. Description of Prior Art

With the developing trend of integration and miniaturization of a motherboard, electrical components and connectors mounted on the motherboard are usually arranged side by side and the intervals therebetween are very small. Thus, a cable is often pulled for separating a cable end connector assembly from a complementary electrical connector and is in danger of separating from a connection with a cable end connector of the cable end connector assembly.

U.S. Pat. No. 6,068,506 discloses a strain relief device for enforcing a connection between an electrical cable and a cable end connector thereof. The strain relief device of the above-mentioned patent includes an elongated sheath and sleeve. The cable consists of a plurality of conductors and a tubular insulator covering. The sheath is made of plastic, and is adapted to be injection molded on the assembly of the rigid sleeve and the multi-conductor cable. The rigid sleeve has an enlarged inner end portion, an enlarged outer end portion and a contracted intermediate portion between the enlarged inner end portion and the enlarged outer end portion. The enlarged inner end portion of the rigid sleeve presses against a front end of the tubular insulator covering of the cable to prevent separation of the cable from the sheath. The enlarged outer end portion of the rigid sleeve is shaped as an outward flange which projects radially and outwardly from an outer end thereof and is received fittingly within the sheath. Additionally, the enlarged inner and outer end portions of the rigid sleeve define an annular groove therebetween in an outer surface of the rigid sleeve. Correspondingly, the sheath has an inward flange which projects radially and inwardly therefrom to be received by the annular groove in the rigid sleeve, thereby preventing separation of the rigid sleeve and the cable from the sheath. The cable engages with the rigid sleeve only by friction therebetween. However, a pull force acting on the cable is usually larger than a friction force between the cable and the rigid sleeve. When the pull force is too large, it can possibly cause undesirable movement of the cable within the strain relief device and break the connection between the cable and the connector.

Hence, it is desirable to provide a cable end connector assembly with an improved strain relief to overcome the disadvantages of the above-mentioned prior art.

SUMMARY OF THE INVENTION

A major object of the present invention is to provide a cable end connector assembly with an improved strain relief for assuring a connection between a cable and a connector thereof.

In order to achieve the objects set forth, a cable end connector assembly in accordance with the present invention comprises a cable end connector, a cable, a cable clamp for firmly clamping the cable and providing a strain relief for the cable, and a cover over-molded with the cable end connector and the cable. The cable end connector comprises an insulative housing and a plurality of contacts received in the insulative housing. The cable has a plurality of conductive wires with leads electrically connected to the contacts. The cable clamp comprises a first crimper and a second crimper mated with each other to accommodate the cable therebetween. The first crimper has a frame-shaped first clamping portion engaging with the cable, a plurality of latching arms, and a retention finger extending from the first clamping portion and sticking into the cable. The second crimper has a plate-shaped second clamping portion engaging with the cable and defines a plurality of latching apertures for firmly locking the latching arms and a through hole for receiving the retention finger. The first and the second crimpers have a plurality of retaining wings extending from the first and the second clamping portions to engage with the cover.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
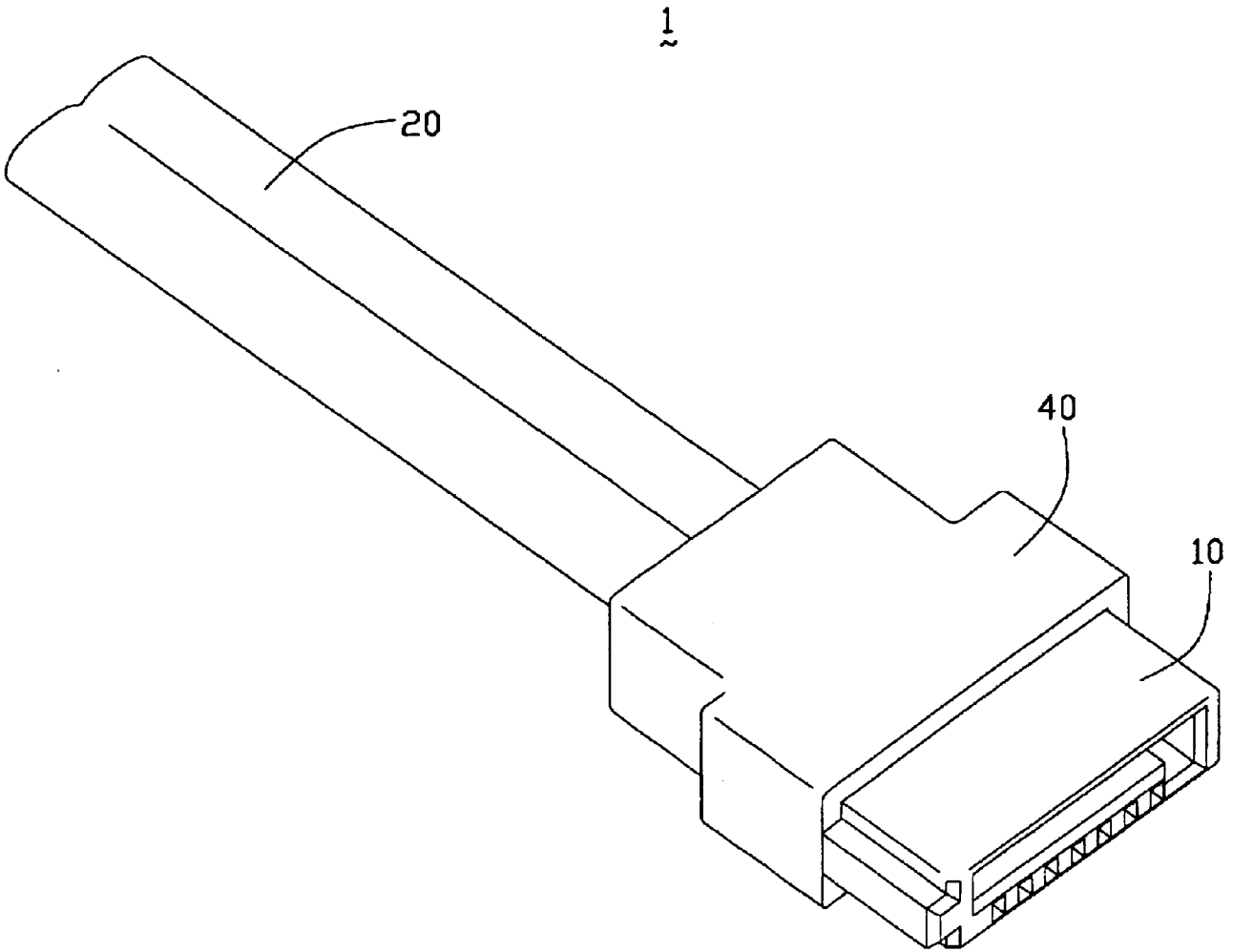
FIG. 1 is a perspective view of a cable end connector assembly in accordance with the present invention.
Figure 2:
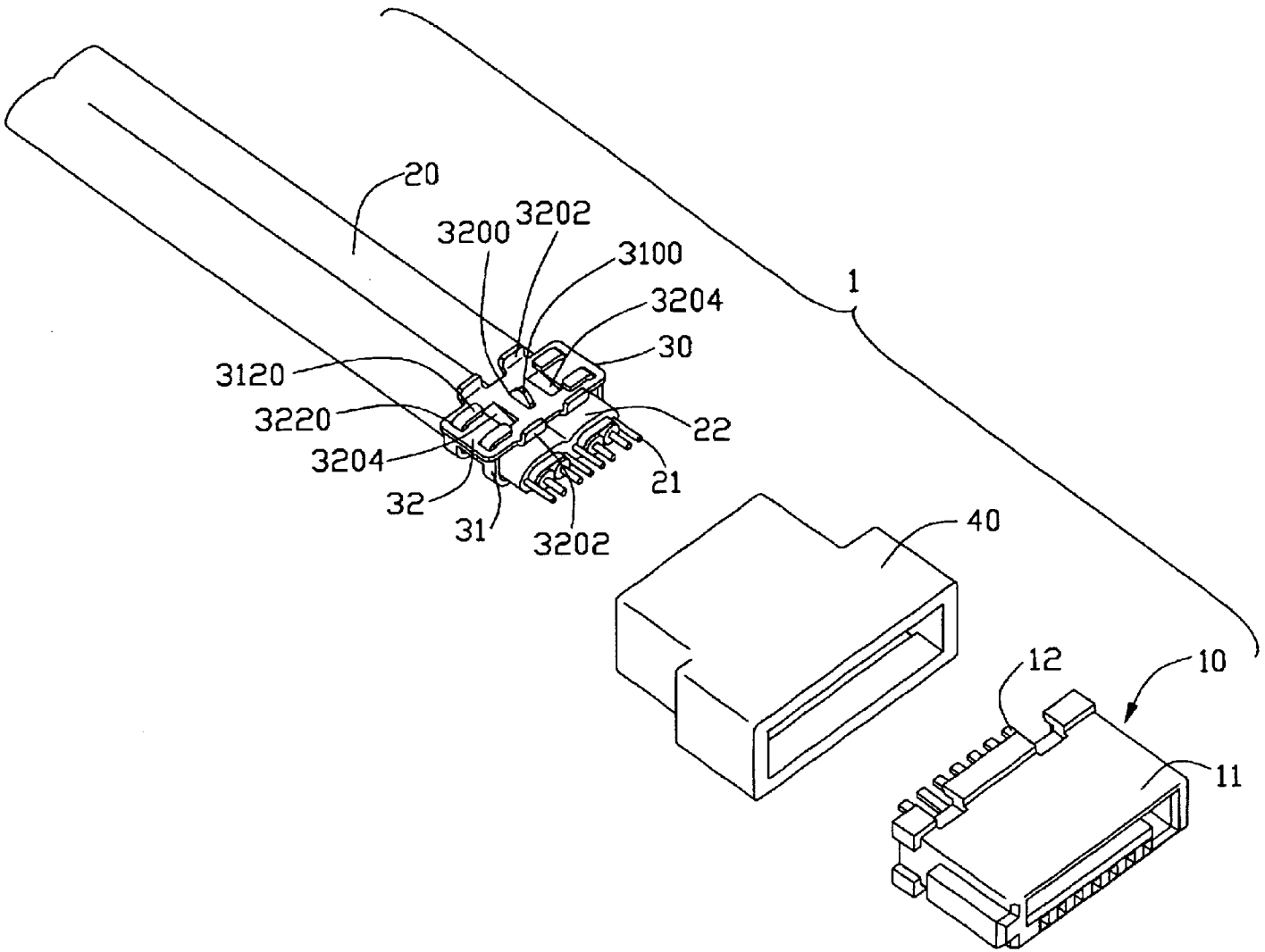
FIG. 2 is a partially exploded, perspective view of the cable end connector assembly before over-molding.
Figure 3:
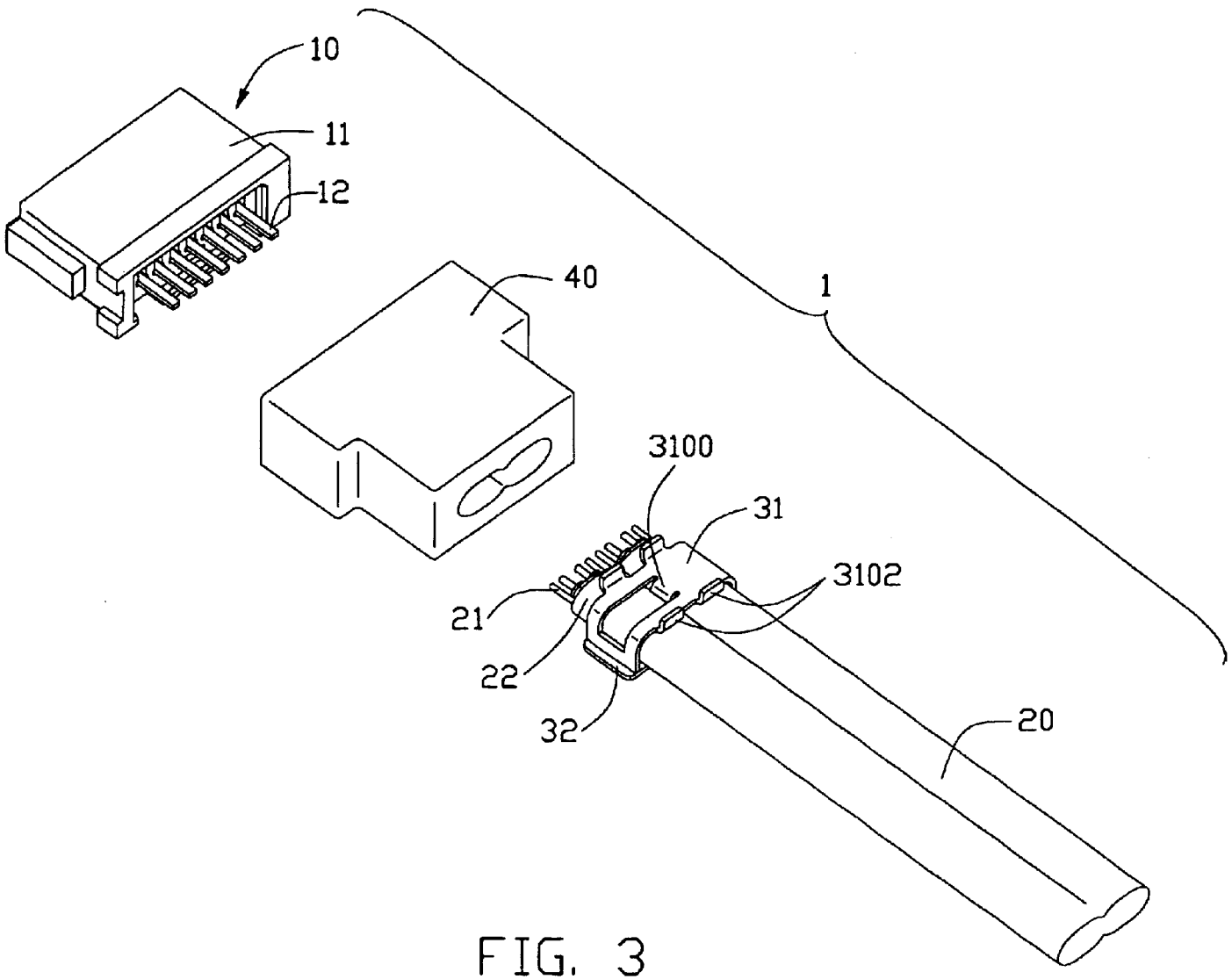
FIG. 3 is a view similar to FIG. 2, but taken from another aspect.

Referring to FIGS. 1 to 3, a cable end connector assembly 1 in accordance with the present invention generally mates with a complementary electrical connector (not shown) mounted on a printed circuit board (not shown), and comprises a cable end connector 10, a cable 20 electrically connecting with the cable end connector 10, a strain relief that is in the form of a cable clamp 30 adapted to clamp a front end of the cable 20 tightly, and a cover 40 over-molded with a rear end of the cable end connector 10, the front end of the cable 20 and the strain relief 30.

The cable end connector 10 comprises a insulative housing 11 and a plurality of electrical contacts 12 fixed to the insulative housing 11.

The cable 20 comprises a plurality of conductive wires 21 enclosed by an outer insulative jacket 22. The conductive wires 21 have leads partly exposed beyond the outer insulative jacket 22 for electrically connecting to the contacts 12 of the cable end connector 10.

Figure 4:
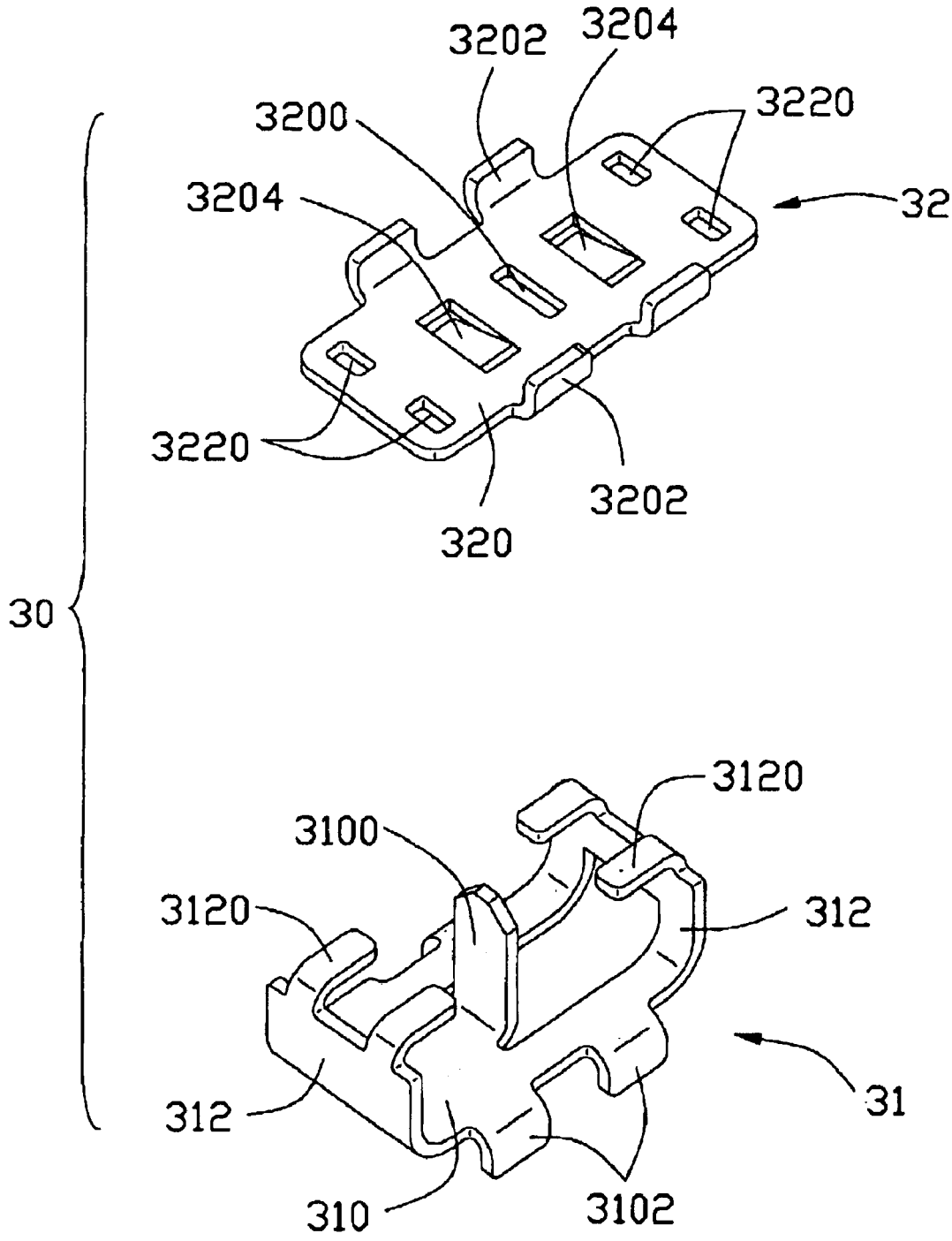
FIG. 4 is an exploded, perspective view of a cable clamp in accordance with the present invention.
Figure 5:
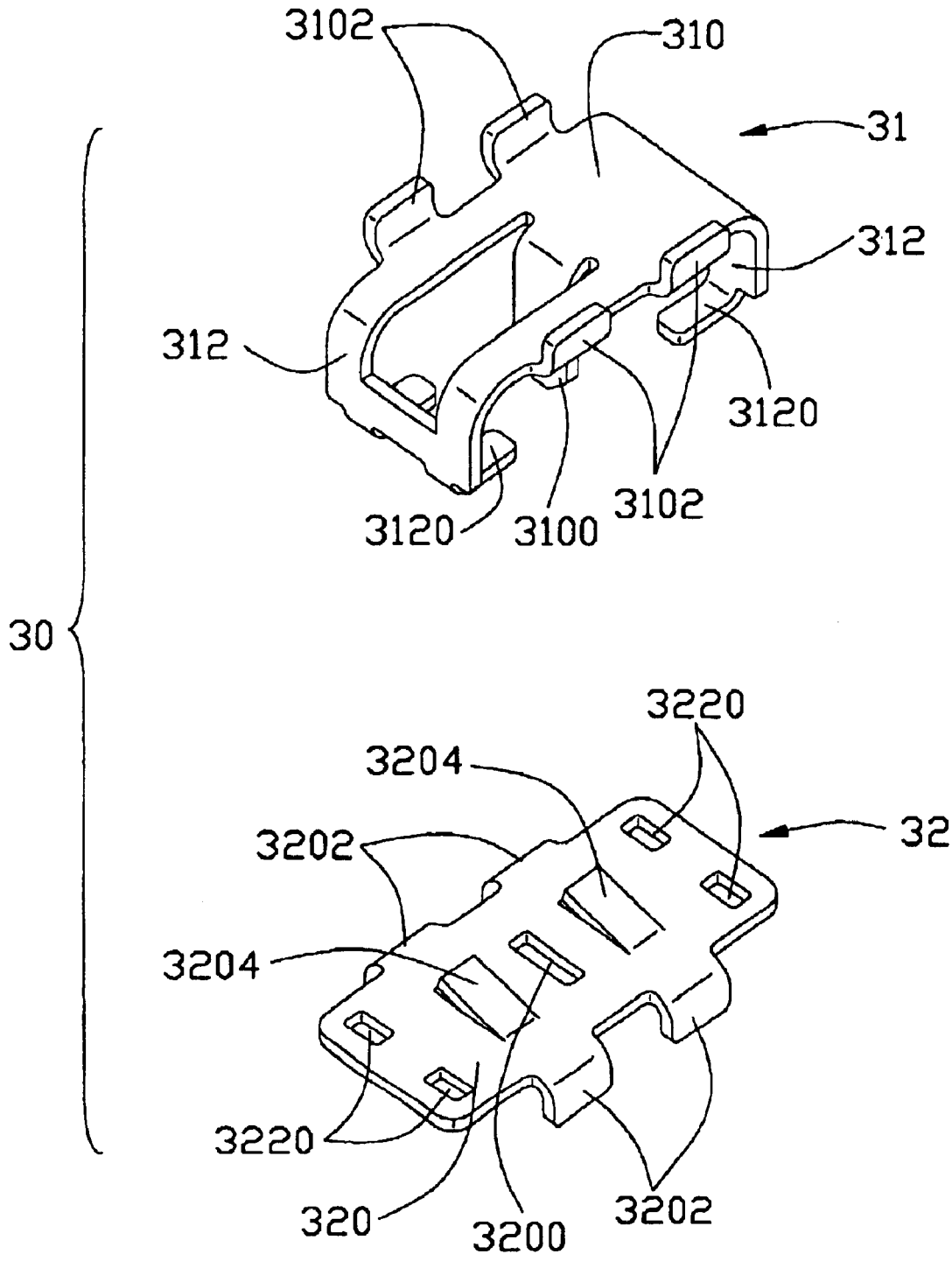
FIG. 5 is a view similar to FIG. 4, but taken from another aspect.

Referring to FIGS. 4 and 5, the cable clamp 30 comprises a metallic first crimper 31 and a metallic second crimper 32 mated with the metallic first crimper 31 to accommodate the cable 20 therebetween.

The first crimper 31 includes a planar portion 310 and two opposite side portions 312 extending from opposite longitudinal ends of the planar portion 310 and perpendicular to the planar portion 310. The planar portion 310 and two opposite side portions 312 form a frame-shaped first clamping portion engaging with the cable 20. Each of side portions 312 provides a pair of latching arms 3120 extending from an upper end thereof, and the pair of latching arms is bent horizontally and inwardly. A retention finger 3100 is punched inwardly from the planar portion 310 and one side portion 312, and is finally located in the middle thereof. Two corners of an upper end of the retention finger 3100 are cut away so as to stick through the cable 20 and enhance the retention between the first crimper 31 and the cable 20. The planar portion 310 further includes a pair of retaining wings 3102 extending outwardly from each of opposite ends thereof to engage with the cover 40.

The second crimper 32 includes a plate-shaped second clamping portion 320 engaging with the cable 20. The second crimper 32 defines a pair of latching apertures 3220 at each longitudinal end thereof to correspond to the pair of latching arms of the first crimper 31. The second crimper 32 defines a through hole 3200 in the center thereof to correspond to the retention finger 3100 of the first crimper 31. The second crimper 32 has a pair of retaining wings 3202 extending outwardly from each of opposite ends thereof to provide more retention with the cover 40. The second crimper 32 further has a pair of spring tabs 3204 punched inwardly therefrom adjacent to the through hole 3200.

In assembly, as shown in FIGS. 2 and 3, the first crimper 31 of the cable clamp 30 is attached to the front end of the cable 20. The retention finger 3100 of the first crimper 31 sticks through the outer insulating jacket 22 of the cable 20 from an upper outer surface to a lower outer surface of the insulating jacket 22. The first clamping portion of the first crimper 31 engages the cable 20 with the planar portion 310 and the two side portions 312 thereof engaging with one flat side and two opposite arc sides of the cable, respectively. The second crimper 32 of the cable clamp 30 is assembled onto the first crimper 31 with the second clamping portion 320 covering the other flat side of the cable 20. The latching arms 3120 of the first crimper 31 lock in the latching apertures 3220 of the second crimper 32. The retention finger 3100 of the first crimper 31 extends through the through hole 3200 of the second crimper 32. The spring tabs 3204 of the second crimper 32 press against the cable 20. In such a way, the first and the second crimpers 31, 32 of the cable clamp 30 firmly lock the cable 20 therebetween.

The leads of the conductive wires 21 of the cable 20 are respectively retained to tail portions of the corresponding contacts 12 of the cable end connector 10 to electrically connect the cable end connector 10 with the cable 20. The cover 40 preferably formed of molded plastic or polymer material is over-molded with the rear end of the cable end connector 10, the front end of the cable 20 and the strain relief 30. The retaining wings 3102, 3202 of the first and the second crimpers 31, 32 are interferentially engaged with the cover 40 for enhancing the retention force between the cable clamp 30 and the cover 40.

Through cooperation between the first crimper 31, the second crimper 32, the cable 20, and the cover 40, a pull force acting on the cable 20 relative to the cable end connector 10 can be in turn transmitted to the cable clamp 30 and the cover 40. Therefore, the cable end connector assembly 1 provides a good strain relief for the cable 20 and achieves the goal of assuring a reliable engagement between the cable 20 and the cable end connector 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector comprising an insulative housing and a plurality of contacts received in the insulative housing;

a cable comprising a plurality of conductive leads electrically connecting with the contacts and an outer insulating jacket enclosing the conductive leads;

a strain relief clamping the cable and having a retention finger sticking through the outer insulating jacket of the cable from an upper outer surface to a lower outer surface of the jacket; and a cover partially enclosing the electrical connector, the cable and the strain relief.

2. The electrical connector assembly as claimed in claim 1, wherein the cover is over-molded with a rear end of the electrical connector, a front end of the cable and the strain relief.

3. The electrical connector assembly as claimed in claim 1, wherein the strain relief comprises a first crimper and a second crimper mated with the first crimper to accommodate the cable therebetween.

4. The electrical connector assembly as claimed in claim 3, wherein the first crimper comprises a planar portion and two opposite side portions extending from opposite ends of the planar portion to form a first clamping portion for clamping the cable.

5. The electrical connector assembly as claimed in claim 4, wherein the retention finger is punched from the planar portion and one of the side portions of the first crimper, and is located in the middle of the planar portion.

6. The electrical connector assembly as claimed in claim 4, wherein the first crimper comprises a plurality of latching arms extending from each side portion and the second crimper defines a plurality of latching apertures for receiving the latching arms.

7. The electrical connector assembly as claimed in claim 4, wherein the first crimper has a plurality of retaining wings extending outwardly from opposite ends of the planar portion thereof.

8. The electrical connector assembly as claimed in claim 4, wherein the second crimper comprises a second clamping portion to clamp the cable.

9. The electrical connector assembly as claimed in claim 8, wherein the second crimper has a plurality of retaining wings extending outwardly from opposite sides of the second clamping portion.

10. The electrical connector assembly as claimed in claim 3, wherein the second crimper defines a through hole for the retention finger to extend therethrough.

11. The electrical connector assembly as claimed in claim 3, wherein the second crimper comprises a pair of spring tabs pressing against the outer insulating jacket of the cable.

12. A strain relief for a cable connector assembly, comprising:

a first crimper having a first clamping portion, a plurality of latching arms, and a retention finger extending from the first clamping portion; and a second crimper having a second clamping portion, a plurality of latching apertures to receive the plurality of latching arms and a through hole to receive the retention finger.

13. The strain relief as claimed in claim 12, wherein the first clamping portion comprises a planar portion and two opposite side portions extending from opposite ends of the planar portion and perpendicular to the planar portion.

14. The strain relief as claimed in claim 13, wherein the latching arms extend horizontally and inwardly from upper ends of the side portions.

15. The strain relief as claimed in claim 12, wherein the first crimper and the second crimper have a plurality of retaining wings extending outwardly therefrom.

16. The strain relief as claimed in claim 12, wherein the second crimper comprises a pair of spring tabs adapted for pressing against a cable of the cable connector assembly.

17. An electrical connector assembly comprising:

an insulative housing with a plurality of contacts therein;

a cable connected to the contacts with a jacket enclosing a plurality of conductors therein;

a strain relief grasping a front portion of the jacket and including two discrete parts with means for fixing to each other;

an outer cover over-molded around both the housing and a front portion of the cable; wherein said strain relief includes first means for being embedded in the outer cover and second means for being embedded in the jacket.

* * * * *